US007109823B1

(12) United States Patent
Schaffner

(10) Patent No.: US 7,109,823 B1
(45) Date of Patent: Sep. 19, 2006

(54) IMAGE GUIDE COUPLER SWITCH

(76) Inventor: James H. Schaffner, 10560 Alabama Ave., Chatsworth, CA (US) 91311

( * ) Notice: Subject to any disclaimer, the term of this patent is extended or adjusted under 35 U.S.C. 154(b) by 56 days.

(21) Appl. No.: 11/030,789

(22) Filed: Jan. 7, 2005

(51) Int. Cl.
*H01P 5/18* (2006.01)
*H01P 1/10* (2006.01)

(52) U.S. Cl. ..... 333/113; 333/108; 333/258

(58) Field of Classification Search ..... 333/101, 333/103, 105, 108, 109, 113, 258; 385/16
See application file for complete search history.

(56) References Cited

U.S. PATENT DOCUMENTS 4,885,589 A * 12/1989 Edward et al. ..... 342/175
6,144,267 A * 11/2000 Saitoh et al. ..... 333/34
6,269,273 B1 * 7/2001 Miller ..... 700/19
6,614,332 B1 9/2003 Yamashita et al.
6,788,918 B1 9/2004 Saitoh et al.

OTHER PUBLICATIONS

Ke Wu and Liang Han, Hybrid Integration Technology of Planar Circuits and NRD-Guide for Cost-Effective Microwave and Millimeter-Wave Applications, IEE Transactions on Microwave Theory and Techniques, vol. 45, No. 6, Jun. 1997, pp. 946-954, USA.
P. Kwan, C. Vittoria, Scattering Parameters Measurement of a Nonreciprocal Coupling Structure, IEE Transactions on Microwave Theory and Techniques., vol. 41, No. 4, Apr. 1993, pp. 652-657, USA.
H. Kogelnik, R. Schmidt, Switched Directional Couplers with Alternating Deltabeta, IEEE Journal of Quantum Electronics, vol. QE-12, No. 7, Jul. 1976, pp. 396-401, USA.
J. Encinau, J. Badenes, J. Cepero, R. Martin, Theoretical and Experimental Results for Metal-Strip-Loaded Image-Guide Antennas, pp. 917-920, Universidad Politecnica de Madrid, Spain.
K. Button, J. Wiltse, Dielectric Waveguide-Type Millimeter-Wave Integrated Circuits, Infrared and Millimeter Waves, vol. 4, Ch. 5, Millimeter Systems, 1981, pp. 199-273.
Y. Shih, J. Rivera, T. Itoh, Directive Planar Excitationof An Image-Guide, 1981 IEEE, Department of Electrical Engineering, The University of Texas, Austin, Texas, pp. 5-7.
E. Marcatili, Dielectric Rectangular Waveguide and Directional Coupler for Integrated Optics, The Bell System Technical Journal, Sep. 1969, pp. 2071-2102.

* cited by examiner

*Primary Examiner*—Dean Takaoka
(74) *Attorney, Agent, or Firm*—Christopher R. Balzan, Esq.

(57) ABSTRACT

In one embodiment, an image guide coupler switch is provided having a dielectric image guide coupler with a coupling control circuit. In this embodiment the coupling control circuit has at least one field pick up probe which extends at least part way across the image guide coupler. A switch is connected in series with the at least one field pick up probe. An optional capacitor my be provided in series with the series with the switch. In some embodiments, a pair of field pick up probes is provided, with the switch being connected in series with and between the pair of field pick up probes. Some embodiments may have multiple pairs of field pick up probes, each having a switch connected in series with a pair of field pick up probes. An optional capacitor may be provided in series with the pair of field pick up probes.

33 Claims, 5 Drawing Sheets

IMAGE GUIDE COUPLER SWITCH

BACKGROUND

At very high frequencies, 30 to 300 GHz for millimeter wave frequency band, typical integrated circuit transmission lines, such as microstrip or coplanar waveguide, become very lossy due to conductor and dielectric losses, and metal and substrate surface irregularities which can cause unwanted reflections and radiation. At these high frequencies, dielectric waveguides, of which there are a number of different forms provide a lower loss alternative to signal routing.

Conventional dielectric waveguide switches require a transition from the dielectric waveguide to a transmission line which leads to a localized switch circuit. Typical transmission lines have a metal strip on the top side of the circuit substrate and a metal ground on the bottom of the circuit substrate, or coplanar waveguide which has a signal strip on the top side of the substrate and two metallic grounds also on the substrate top-side which are separated on each side of the strip by a gap which is determined by the desired characteristic impedance of the line. These transitions are typically necessary to connect the image guide to sources, mixers, amplifiers, and switching, but they degrade the overall performance of the image guide system through parasitic reflections and radiation which increase as the frequency of the system increases.

At very high frequencies, these transitions and transmission lines add RF loss to the overall dielectric waveguide circuit. So, at very high frequencies, 30 Ghz and up, switches tend to be either very lossy or narrow band. What is needed is a high frequency switch that provides signal switching without having to remove the signal from the dielectric waveguide. Also, what is needed is a means to avoid the RF losses associated with metallic transmission lines at higher frequencies. Furthermore, what is needed is a device that does not require a transition from dielectric waveguide to printed circuit transmission line. This is particularly true in high frequency applications.

One alternative approach utilizes an image guide coupler. In this approach, a ferrite is placed between the image guides along the coupling region as disclosed in an article by P. Kwan and C. Vittoria, entitled "Scattering Parameters Measurement of a Nonreciprocal Coupling Structure," in *IEEE Trans. Microwave Theory Technique*, Vol. 41, No. 4, April 1993, pp. 652–657. A magnetic field bias applied to the ferrite controls the coupling between the image lines. Thus, the coupling coefficient is modified by an external applied magnetic field bias on the ferrite for isolators, filters, modulators, switches, and phase shifters. With appropriate external applied magnetic field bias on the ferrite, the four port device prior art can be made into an image guide switch.

With such an approach, however, there are several problems. One problem is that ferrites become lossy at high frequency. What is need is a high frequency switch capable of providing low loss. Another problem is that ferrites are not easy to integrate into monolithic structures. Thus, there is a need for a switch capable of easy integration into monolithic integrated circuit structures.

SUMMARY

In one embodiment, an image guide coupler switch is provided having a dielectric image guide coupler and a coupling control circuit. In this embodiment the coupling control circuit has at least one field pick up probe which extends at least part way across the image guide coupler. A switch is connected in series with the at least one field pick up probe. An optional capacitor my be provided in series with the series with the switch. In some embodiments, a pair of field pick up probes is provided, with the switch being connected in series with and between the pair of field pick up probes. Some embodiments may have multiple pairs of field pick up probes, each having a switch connected in series with a pair of field pick up probes. An optional capacitor may be provided in series with the pair of field pick up probes.

In another embodiment, an image guide coupler switch is provided including a pair of dielectric waveguides adjacent to a metallic ground. The pair of dielectric waveguides have portions in close proximity to each other so as to allow coupling of electromagnetic signals from one of the pair of dielectric waveguides to an other of the pair of dielectric waveguides. A coupling control circuit extends across the pair of dielectric waveguides. In some embodiments, the coupling control circuit includes a field pick up probe which extends adjacent at least one of the dielectric waveguides. A capacitor and a switch are connected in series with the field pick up probe. The coupling control circuit may have a pair of field pick up probes with each field pick up probe extending adjacent a respective one of the dielectric waveguides. Some embodiments may have an array of pairs of field pick up probes, with a series connected capacitor and switch connected between each pair of pick up probe.

BRIEF DESCRIPTION OF THE DRAWINGS

The features and advantages of the present invention will be better understood with regard to the following description, appended claims, and accompanying drawings where:

DESCRIPTION

Figure 1:
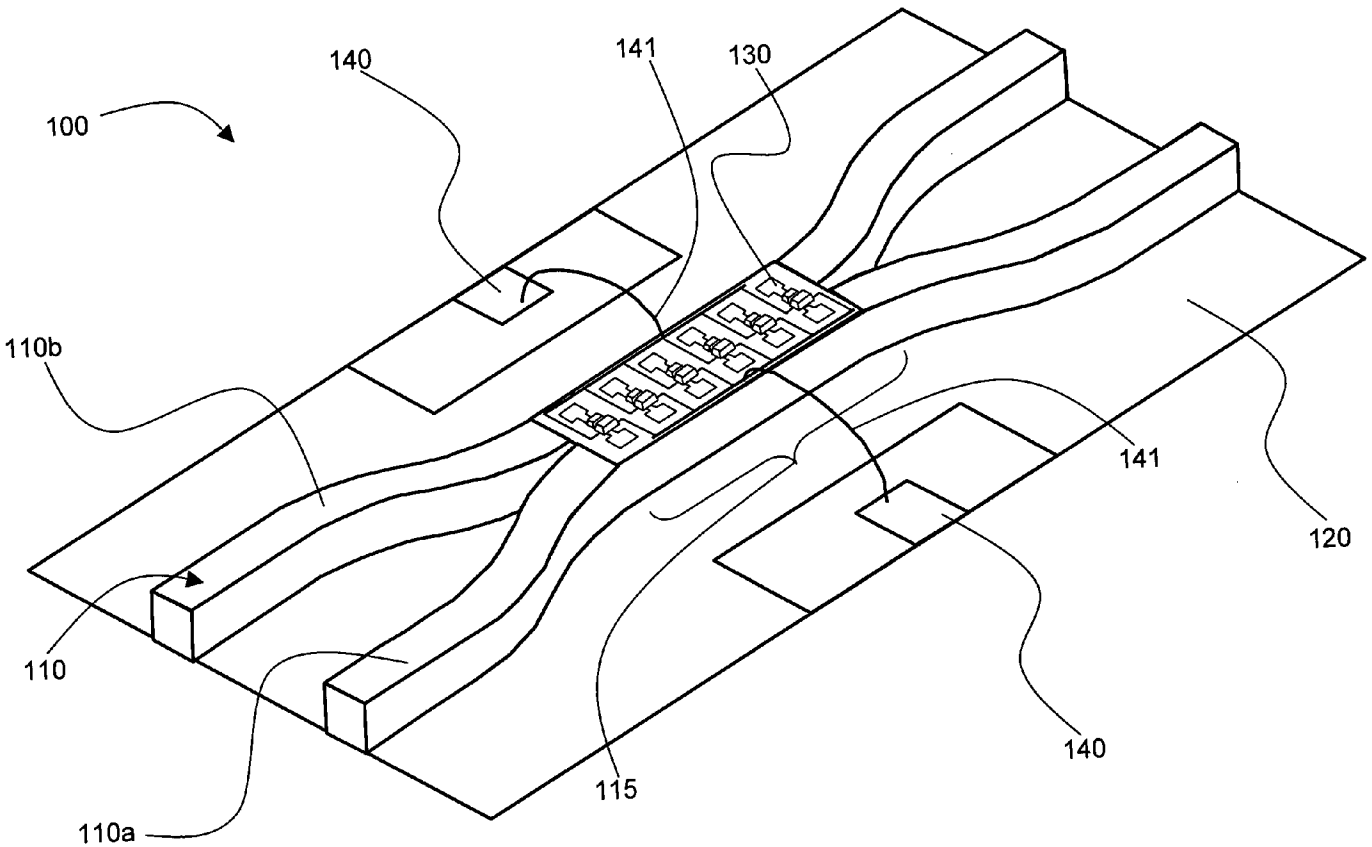
FIG. 1 shows a perspective view of an image guide coupler switch in accordance with one embodiment of the present invention.

FIG. 1 shows a perspective view of an image guide coupler switch 100 in accordance with one embodiment of the present invention. An image guide coupler 110 has two waveguides 110*a* and 110*b*, which may be dielectric rods or bars, located on a ground plane 120. Waveguides 110*a* and 110*b* can be machined, molded, or formed by masking, depositing and/or etching techniques, depending on the material used and the particular application. A number of low-loss dielectric materials exist from which the dielectric waveguides 110*a* and 110*b* can be made. For example materials such as Rexolite® (produced by C-Lec Plastics, Inc. of Philadelphia, Pa.), Hi-K material (such as produced by Emerson & Cuming, located in Randolf, Mass.), fused silica, Teflon®, ceramics, and even high resistivity semiconductors such as semi-insulating GaAs.

Typically, the image guide coupler 110 is partially surrounded by air so it can support propagating electromagnetic modes. (In the embodiment of FIG. 1, the metallic ground plane 120 provides a base for the image guide coupler 110, and a low-loss metallic structure for the lowest order waveguide mode in the image guide coupler 110. The metallic ground plane 120 may be made from a solid metal slab, or from metal deposited on a semiconductor or insulating substrate.

Since the image guide coupler 110 is not completely surrounded by metal, some of the guided field is located physically outside of waveguide 110*a* or 110*b*, in which it is traveling. The waveguides 110*a* and 110*b* are brought into close proximity at a coupling region 115 so that an electromagnetic field traveling in one waveguide 110*a* has some field overlap within the other waveguide 110*b*. The result is that energy can be transferred from one line to the other, over a given interaction length, as in an image guide coupler. The length of the waveguides 110 of the image guide coupler in the coupling region 115 is such that signal crosses over at the end of the coupling region 115. Further, the guides are close enough together so the evanescent field, which extends outside the one guide, will extend into the other guide. If the guide is too long the signal will sinusoidally flip-flop. In one embodiment, discussed below, the length of the waveguides 110*a* and 110*b* are selected so that there is complete cross over coupling from one guide to the other as a result of the natural evanescent field extending into the adjacent waveguide at the coupling region 115. The separation between the waveguides 110*a* and 110*b* is increased beyond the coupling region 115 so that they do not couple any longer. The strength of the coupling depends upon the proximity of the waveguides 110*a* and 110*b*, and how confined the fields are within the waveguides, i.e. the waveguide material and the surrounding medium.

Figure 2:
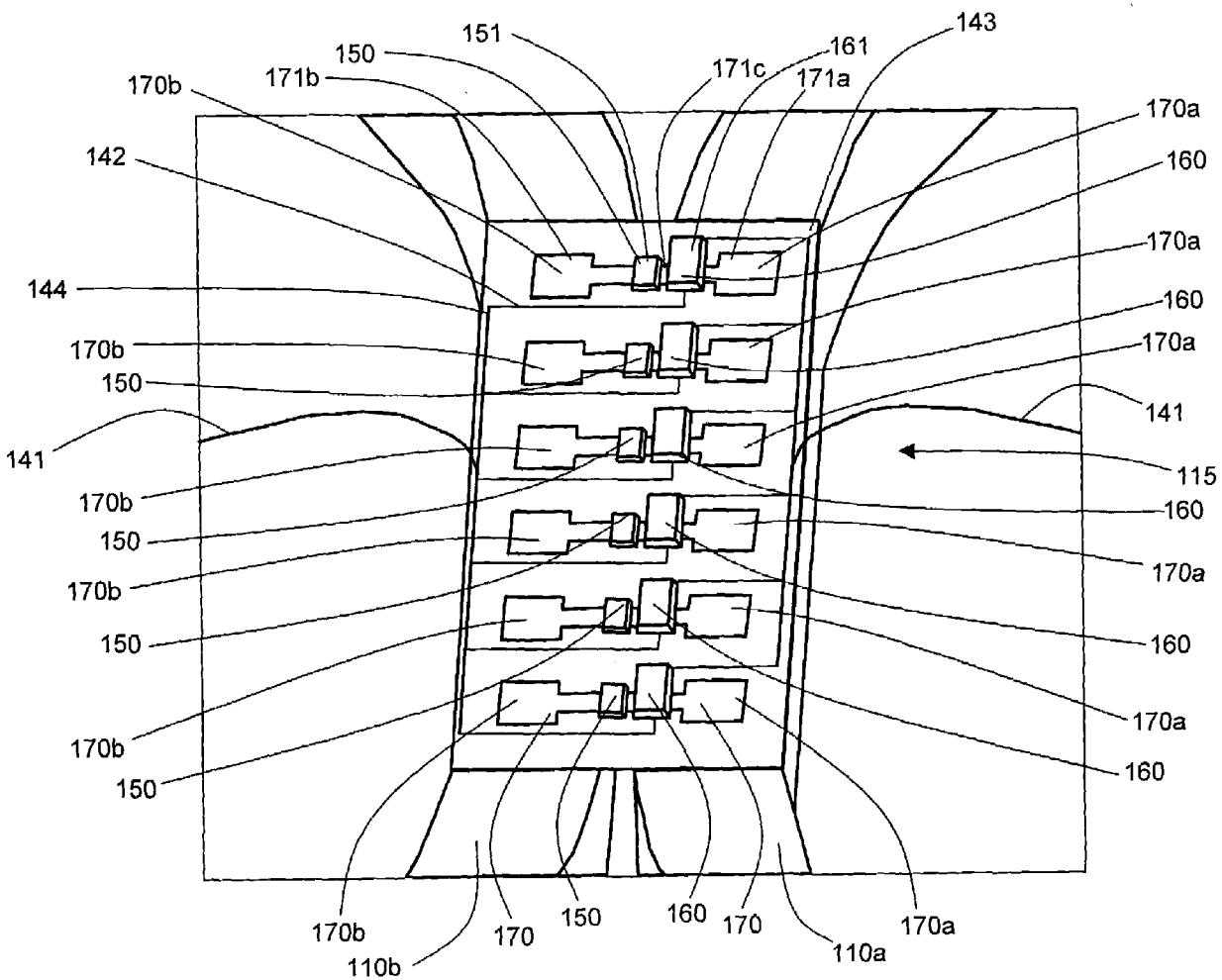
FIG. 2 shows an enlarged perspective view of the coupling region of FIG. 1 in accordance with one embodiment of the present invention.

Coupling control circuitry 130 is positioned adjacent to the image guide coupler 110, and is used to influence the coupling of the image guide coupler 110. FIG. 2 shows an enlarged perspective view of the coupling region 115 of FIG. 1 in accordance with one embodiment of the present invention. An array of capacitors 150, which may be switched using switches 160, are shown straddling the two waveguides 110*a* and 110*b*. The array of capacitors 150 are shown above the coupling region 115, where the two waveguides 110*a* and 110*b* are in close proximity. Field pick-up probes 170 extend over the two guides 110*a* and 110*b*. The field pick-up probes 170 may be a metal such as copper, or an other transmissive material.

The capacitor array 150, as well as the field pick-up probes 170, can be constructed on a very thin (approximately 25 micrometers) layer of Kapton®, which straddles the two waveguides 110*a* and 110*b* and adheres to the tops of the waveguides 110*a* and 110*b*. Kapton® is available from DuPont, of Circleville, Ohio, www.dupont.com. Other printed circuit board substrates could also be used, but the capacitance values and spacing would need to be tailored for the specific substrate parameters.

The coupling control circuit 130 includes a pair of electric field pick-up probes 171*a* and 171*b*, which are connected to a series circuit having a capacitor 151 and a switch 161. The capacitor 151 and the switch may be integrally formed, or be separate structures interconnected by a segment 171*c* between the capacitor 151 and the switch 161. The capacitor may be a chip capacitor and the switch 161 could be pin a diode, transistor, MEMS switch, etc. Bias lines 142 and 143 may be used to actuate the switch 161. The coupling control circuit may have a single capacitor 151 and switch 161 connected between a pair of field probes 171*a* and 171*b*. In some embodiments as shown in FIG. 2, the coupling control circuit 130 may have an array of electric field pick-up probes 170*a* and 170*b*. In such an embodiment, all switches 160 of the array may be turned on together. To facilitate this, the positive bias lines of each switch can be connected to a common bus line 144, while the negative bias lines can be connected to a common bus line 145. Wires 141 can lead from these bus lines 144 and 145 to respective bias control pads 140 which are located away from the image guide coupler, as shown in FIG. 1.

When the switches 160 are not actuated there is an effective open circuit between the two field pick-up probes 171*a* and 171*b*. In this case coupling between the two waveguides 110*a* and 110*b* occurs only from the overlap of the electric field of one waveguide with the dielectric from the other waveguide. When the waveguides 110*a* and 110*b* are in close proximity, energy is continually transferred from one waveguide to the other. If the two waveguides 110*a* and 110*b* have identical cross sectional dimensions, at a particular length, known as the coupling length, all of the signal from the propagating mode of one guide will transfer completely to the propagating mode of the other guide. This coupling length depends upon the frequency of the signal, the dielectric constant of the image guide material, and the separation between the guides. These factors can be determined from measurements, or from simulation software, such as Ansoft HFSS®, Asoft Corp., Pittsburg, Pa., www.ansoft.com.

In some embodiments, the cross-over of energy occurs when the switches 160 are not actuated, that is when they are open circuited. This is known as the "cross" state. When the switches are turned on, the coupling between the two waveguides 110*a* and 110*b* in the coupling region 115 is enhanced. The field pick-up probes 170*a* and 170*b* are now electrically connected together, so that RF current can flow between the field pick-up probes 170*a* and 170*b*. Thus, current induced in the field pick-up probes 170*a* and 170*b* from the propagating field in one of the image guides, in turn induces a propagating field in the other image guide. Most of the field transfer between the image guides still occurs from the close proximity of the waveguides 110, however, the now connected field pick-up probes 170*a* and 170*b* enhances this coupling by a small amount at each member of the array.

By arranging pick-up probes 170*a* and 170*b*, switches 160, and capacitors 150 in an array down the coupling region, enhanced coupling is distributed along the length of the active region 115 image guide coupler. The amount of coupling is dependent upon the location and shape of the field pick-up probes 170*a* and 170*b* and the capacitance of each switch and capacitor 150 and 160, and the distance between each switch 160 and capacitor 150. For the above embodiment, the effective coupling coefficient in this case is large enough to allow the RF mode from one guide cross over to the other guide and then back to the original guide in one cross-over coupling length. This is known as the "bar" state of the coupler. Thus, if the two waveguides 110*a* and 110*b* are identical and if the coupling region is long enough, energy will couple completely from one guide 110*a* to the other 110*b*, and then couple back to the original guide 110*a*. Again, simulation or measurements can be used to determine the parameters for this switch/capacitor array. Thus, a coupling control circuit 130 is provided between the "cross" and "bar" states which is controlled by a voltage applied to the array switches 160.

When the capacitor array 150 is switched "on", the coupling is enhanced, which causes the electromagnetic energy to cross into the other guide and then back into the original guide in the coupling length. When the capacitor array 150 is switched "off" the energy crosses into the other guide, but does not cross back to the original guide. Thus, the image guide coupler switch 100 acts as a switch for the electromagnetic wave between the two waveguide outputs.

Six switches 160 and capacitors 150 shown are arrayed in FIG. 2, although the exact number required for the switching function to occur may be determined through simulation and/or experiments. Furthermore, although shown as an array, it is possible in some embodiments to provide single combined components, i.e. a single capacitor, switch, or pair of probes, if desired. As discussed below, however, one advantage in an array of capacitors 150 and/or switches 160 is that power dissipation is distributed through the array. In some embodiments (not shown), it is possible to omit the capacitor or array of capacitors 150 from the coupling control circuit 130. In such an embodiment, however, the inductance of the field pick-up probes and switch(es) would have to be low enough for high frequency applications. The capacitor array discussed above, effectively increases the dielectric constant between the two dielectric guides which increases the coupling between the two waveguides. Thus, some embodiments control of the coupling coefficient is achieved using a switched capacitor array which is located proximate to the two guides. In some embodiments, the capacitor could be a gap, or an array of gaps between the pick-up probes. In certain other embodiments, the capacitor, or the capacitor array 150 may be completely omitted from the coupling control circuit 130, with the field pick up probes 170 being connected via switches 160.

Several embodiments of the present invention allow lower power losses. Because the entire energy of the field is not coupled through the coupling control circuit 130, losses are reduced. There is little loss in the field pick-up probes, switches and/or capacitors since most of the field density remains in the dielectric waveguide. In this respect the field pick-up probes, the switch and/or capacitor array forms a perturbation to the electromagnetic properties of the image guide coupler.

The bias lines 142 and 143 may be fabricated small to provide high inductance to ensure that RF energy is not lost in the switch bias lines. The pick-up probes 170*a* and 170*b* are larger to have low inductance. The size of the pick-up probes 170*a* and 170 is dependent on frequency of operation.

In alternate embodiments not shown, a high frequency varactor diodes could replace the capacitor and switch combination in the coupling control circuit. Thus a single varactor, or an array of varactors could be used.

Figure 3:
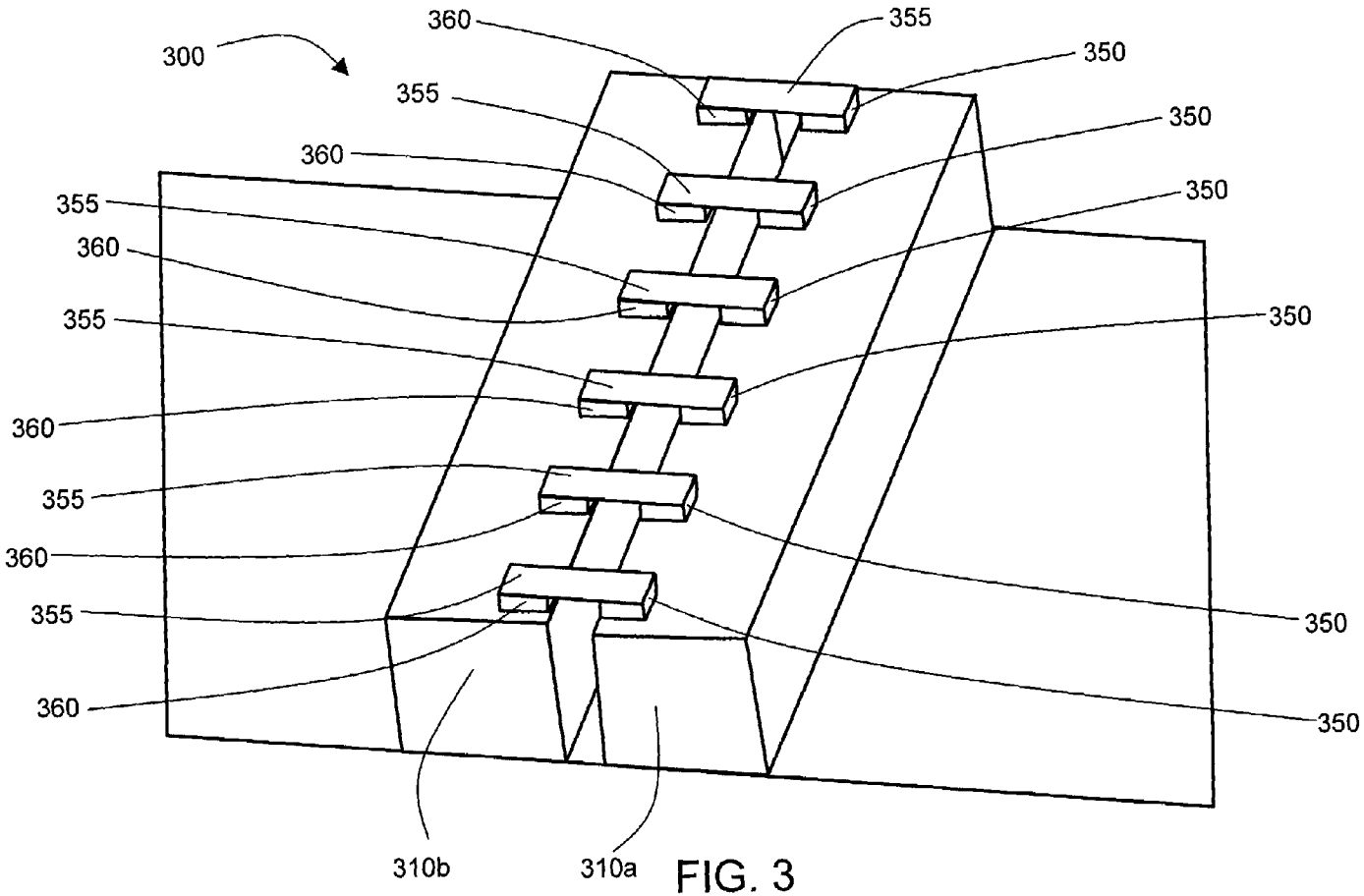
FIG. 3 shows a perspective view of an alternate embodiment of the coupling region of the image guide coupler switch.

FIG. 3 shows a perspective view of an alternate embodiment of the coupling region 315 of the image guide coupler switch 300. In the embodiment shown, the capacitors 350 and the switches 360 contact the waveguides 310*a* and 310*b*, respectively. Interconnect segments 355 connect the capacitors 350 with the switches 360 across the space separating the waveguides 310*a* and 310*b*. The interconnect segments 355 may be conductor material and function as a field pick up probe. Or, in other embodiments the interconnect segments 355 may be a dielectric material. In yet other embodiments (not shown), the capacitors may be omitted, depending on the application. Not shown in FIG. 3 is the interconnect circuitry and control logic for the switches 360, as FIG. 3 is a simplified illustration for example purposes.

Figure 4:
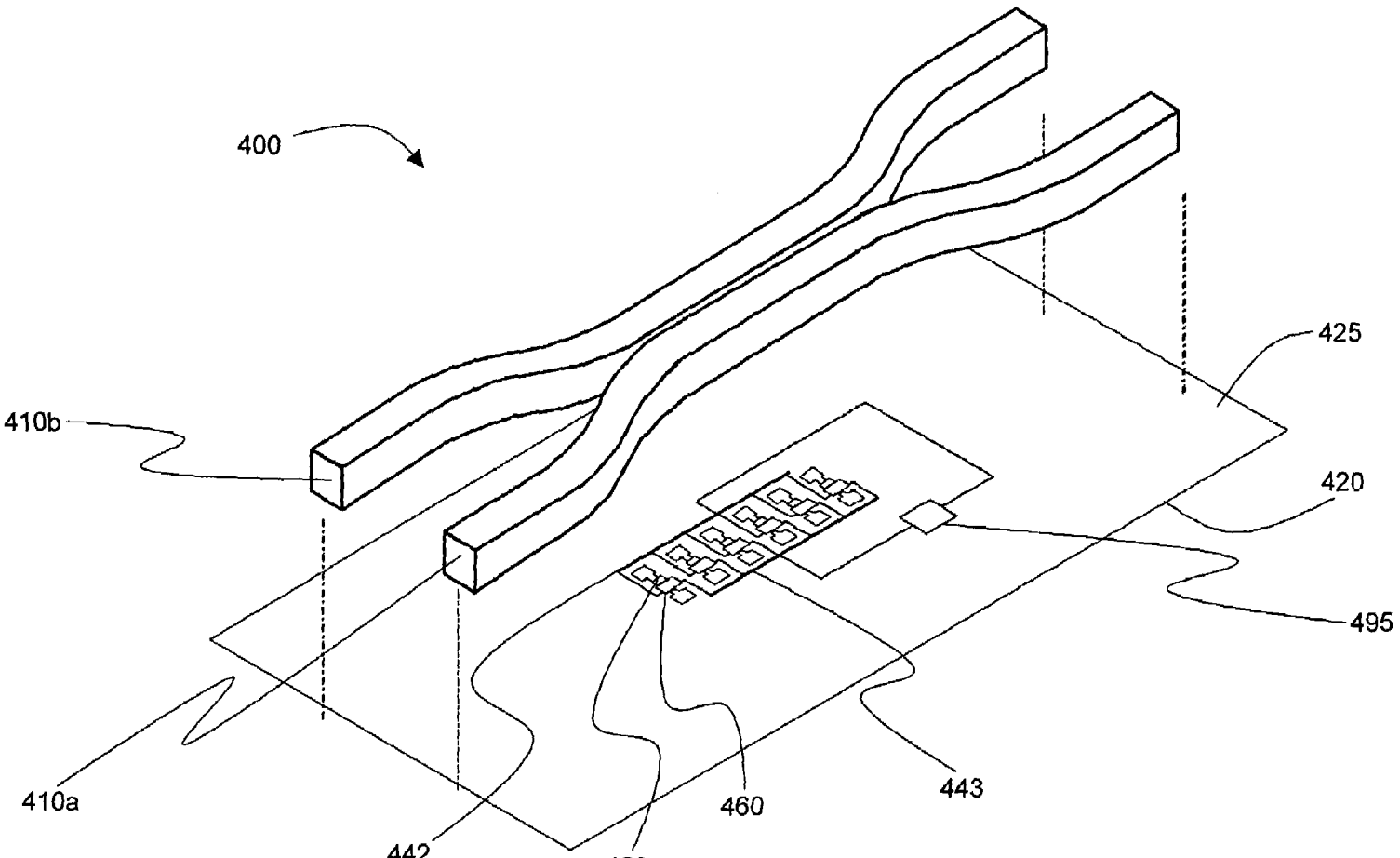
FIG. 4 shows an exploded perspective view of the an alternative embodiment of the image guide coupler switch.

FIG. 4 shows an exploded perspective view of the an alternative embodiment of the image guide coupler switch 400. In this embodiment, the dielectric waveguides 410*a* and 410*b* are attached directly on a monolithic circuit 430 which contains the switches 450 and capacitors 460. For illustration purposes, the waveguides 410*a* and 410*b* are shown lifted off the monolithic circuit 430. The back-side 420 of the substrate 425 may be metallized. This embodiment facilitates monolithic integration of other components, such as the RF power source, control logic, etc. Control logic shown as box 495 may be connected to the bias lines 442 and 443 for controlling the switches 450. The control logic 495 may be located on the substrate 425, or remote from the substrate, depending on the particular application.

Figure 6:
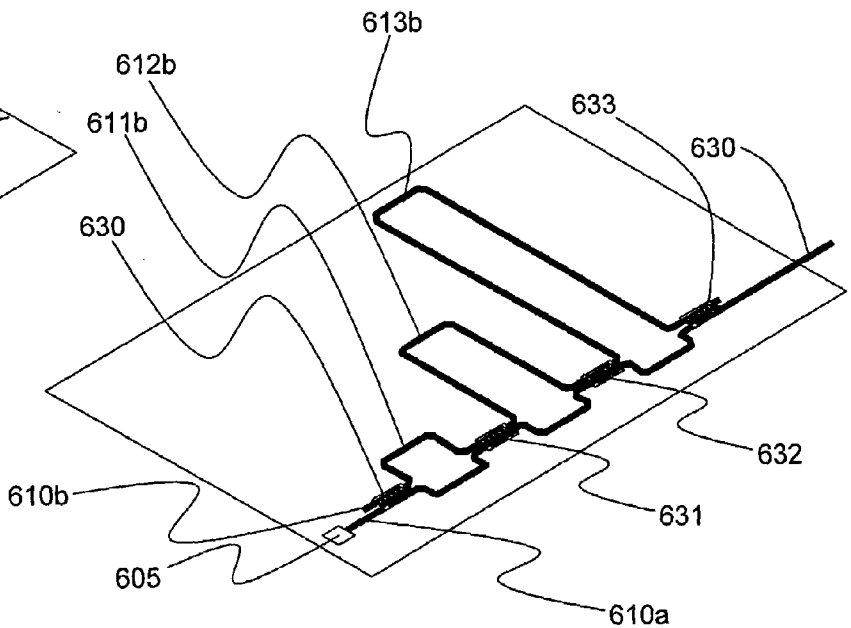
FIGS. 5 and 6 show possible examples of antenna feed structures that may utilize certain embodiments of the image guide coupler switch of the present invention.
Figure 5:
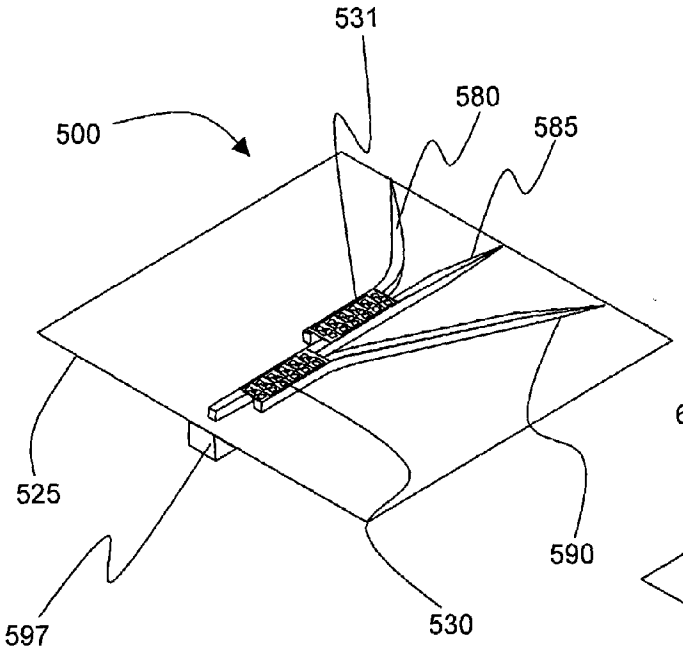

FIGS. 5 and 6 show possible examples of antenna feed structures that may utilize certain embodiments of the image guide coupler switch of the present invention. Shown in FIG. 5, a switched antenna beam structure 500 can radiate a signal in one of a number of directions. The signal is directed to the appropriate image guide radiator 580, 585, or 590 by a set of coupling control circuits 530 and 531. A receiver, a transmitter, or control circuit chip 597 is shown mounted to the back side of the substrate 525 In FIG. 6, a three-bit delay line phase shifter 600 is shown constructed utilizing four coupling control circuits 630–633 to add or remove delay lines 611*b*, 612*b*, or 613*b* in the waveguide 610*b*. A receiver chip 605 is shown adjacent the waveguide 610*a*. Although not shown, an RF source may used to launch the fundamental image guide propagating mode by known adapter techniques. Also, although a pointed radiating element 680 is shown, other types of image guide antennas could be used.

Different embodiments may be constructed for various wavelength signals. Some embodiments can readily be fabricated monolithically as a millimeter wave integrated circuits, as well as for submillimeter wave applications. Various embodiments may be used in millimeter wave systems such as phase shifters, switch networks, or beam steering. High frequency imaging and phased array antennas are some examples which could incorporate certain embodiments of the image guide coupler for collision avoidance radar, high resolution seekers, and broadband communication systems. High power applications are also possible as the coupling circuitry controls the coupling and is not itself handling the full signal power.

Having described this invention in connection with a number of embodiments, modification will now certainly suggest itself to those skilled in the art. As such, the invention is not limited to the disclosed embodiments, except as required by the appended claims.

What is claimed is:

1. An image guide coupler switch comprising:

(a) a metallic ground;

(b) a pair of dielectric waveguides adjacent the metallic ground, the pair of dielectric waveguides having portions in close proximity to each other so as to allow coupling of electromagnetic signals from one of the pair of dielectric waveguides to an other of the pair of dielectric waveguides; and (c) a coupling control circuit extending across the pair of dielectric waveguides, the coupling control circuit comprising:

(i) at least one field pick up probe extending adjacent at least one of the dielectric waveguides;

(ii) a capacitor connected in series with the at least one field pick up probe; and (iii) a switch connected in series with the capacitor.

2. The image guide coupler switch of claim 1 wherein the coupling control circuit comprises a pair of field pick up probes, each field pick up probe of the pair of field pick up probes extending adjacent a respective one of the dielectric waveguides.

3. The image guide coupler switch of claim 2 wherein the coupling control circuit further comprises:

(a) an array of pairs of field pick up probes; and (b) a series connected capacitor and switch connected between pairs of field pick up probes of the array of field pick up probes.

4. The image guide coupler switch of claim 1 wherein the coupling control circuit is located adjacent a side of the dielectric waveguides opposite the metallic ground.

5. The image guide coupler switch of claim 1 wherein the coupling control circuit is located between the metallic ground and the pair of dielectric waveguides.

6. The image guide coupler switch of claim 1 wherein the pair of dielectric waveguides are located on a substrate, and wherein the coupling control circuit is located above the pair of dielectric waveguides.

7. The image guide coupler switch of claim 1 wherein the coupling control circuit is located on a substrate and the pair of dielectric waveguides is located over the coupling control circuit.

8. The image guide coupler switch of claim 1 wherein the capacitor straddles the area between the dielectric waveguides.

9. The image guide coupler switch of claim 1 wherein the capacitor is located lateral to the area between the dielectric waveguides.

10. An image guide coupler switch comprising:

(a) a dielectric image guide coupler; and (b) a coupling control circuit comprising:

(i) at least one field pick up probe extending at least part way across the image guide coupler; and (ii) a switch connected in series with the at least one field pick up probe.

11. The image guide coupler switch of claim 10 further comprising a capacitor connected in series with the switch.

12. The image guide coupler switch of claim 11 wherein the switch and the capacitor are connected between the at least one field pick up probe and a dielectric waveguide of the dielectric image guide coupler.

13. The image guide coupler switch of claim 12 wherein the capacitor is connected between the at least one field pick up probe and a first waveguide of the dielectric image guide coupler, and wherein the switch is connected between the at least one field pick up probe and a second waveguide of the dielectric image guide coupler.

14. The image guide coupler switch of claim 11 wherein the at least one field pick up probe is connected between the capacitor and the switch.

15. The image guide coupler switch of claim 11 further comprising:

(a) an array of field pick up probes extending at least part way across the dielectric image guide coupler; and (b) an array of switches, each switch being series connected with a corresponding field pick up probe of the array of field pick up probes.

16. The image guide coupler switch of claim 15 further comprising an array of capacitors, each capacitor of the array of capacitors being series connected between a dielectric waveguide of the dielectric image guide coupler and a corresponding field pick up probe of the array of field pick up probes.

17. The image guide coupler switch of claim 15 further comprising an array of capacitors, each capacitor of the array of capacitors being series connected with a corresponding switch between a corresponding field pick up probe and a dielectric waveguide of the dielectric image guide coupler.

18. The image guide coupler switch of claim 10 wherein the at least one field pick up probe comprises a pair of field pick up probes, and wherein the switch is connected in series with and between the pair of field pick up probes.

19. The image guide coupler switch of claim 10 wherein the coupling control circuit further comprises a plurality of pairs of field pick up probes, each of the plurality of pairs of field pick up probes comprises a switch connected in series with respective pairs of field pick up probes.

20. The image guide coupler switch of claim 10 wherein the coupling control circuit further comprises a plurality of pairs of field pick up probes, each of the plurality of pairs of field pick up probes comprises a switch and a capacitor connected in series with respective pairs of field pick up probes.

21. An image guide coupler switch comprising:

(a) a dielectric image guide coupler, the dielectric waveguide having a coupling region; and (b) a coupling control circuit connected adjacent the coupling region so as to be capable of influencing the coupling of the dielectric image guide coupler, the coupling control circuit comprising:

(i) at least one field pick up probe extending at least part way across the dielectric image guide coupler;

(ii) a capacitor in series with the at least one field pick up probe; and (iii) a switch connected in series with the capacitor.

22. The image guide coupler switch of claim 21 wherein the coupling control circuit comprises a pair of field pick up probes extending across the dielectric image guide coupler.

23. The image guide coupler switch of claim 22 wherein the capacitor is located between the pair of field pick up probes.

24. The image guide coupler switch of claim 23 wherein the switch is located between the pair of field pick up probes.

25. The image guide coupler switch of claim 24 further comprising an interconnect segment between the capacitor and the switch.

26. The image guide coupler switch of claim 21 wherein the coupling control circuit comprises an array of field pick up probes, an array of capacitors, and an array of switches, each field pick up probe of the array being connected in series with a corresponding switch of the switch array, and a corresponding capacitor of the capacitor array.

27. The image guide coupler switch of claim 26 wherein the array of field pick up probes comprises pairs of field pick up probes extending across the dielectric image guide coupler.

28. The image guide coupler switch of claim 27 wherein each capacitor of the array of capacitors is located between a pair of field pick up probes of the array of field pick up probes.

29. The image guide coupler switch of claim 28 wherein each switch of the array of switches is located between a pair of field pick up probes of the array of field pick up probes.

30. An image guide coupler switch comprising:

(a) a dielectric image guide coupler, the dielectric waveguide having a coupling region; and (b) a coupling control circuit connected across the dielectric image guide coupler, the coupling control circuit comprising:

(i) a capacitor;

(ii) a switch connected in series with the capacitor; and (iii) an interconnect segment in series with the capacitor and switch, the interconnect segment extending across the coupling region.

31. The image guide coupler switch of claim 30 wherein the switch is connected between one dielectric waveguide of the dielectric image guide coupler and the interconnect segment, and wherein the capacitor is connected between an other dielectric waveguide of the dielectric image guide coupler and the interconnect segment.

32. The image guide coupler switch of claim 30 wherein the switch and the capacitor are connected between a dielectric waveguide and the interconnect segment.

33. The image guide coupler switch of claim 30 wherein the coupling control circuit further comprises an array of capacitors, an array of switches, and plurality of interconnect segments, each capacitor of the array of capacitors being connected in series with a corresponding switch of the array of switches via an interconnect segment.

* * * * *

UNITED STATES PATENT AND TRADEMARK OFFICE

CERTIFICATE OF CORRECTION

PATENT NO. : 7,109,823 B1
APPLICATION NO. : 11/030789
DATED : September 19, 2006
INVENTOR(S) : James H. Schaffner It is certified that error appears in the above-identified patent and that said Letters Patent is hereby corrected as shown below:

On the face of the patent, Assignee should be listed as follows:

--Assignee: HRL Laboratories, LLC, Malibu, CA (US)--

Signed and Sealed this

Sixteenth Day of June, 2009

John Doll

JOHN DOLL
*Acting Director of the United States Patent and Trademark Office*